US009784023B2

(12) United States Patent
Al Kayali

(10) Patent No.: US 9,784,023 B2
(45) Date of Patent: Oct. 10, 2017

(54) DOOR BRACE

(71) Applicant: Ayman Osama Al Kayali, Lakewood, OH (US)

(72) Inventor: Ayman Osama Al Kayali, Lakewood, OH (US)

( * ) Notice: Subject to any disclaimer, the term of this patent is extended or adjusted under 35 U.S.C. 154(b) by 26 days.

(21) Appl. No.: 14/172,112

(22) Filed: Feb. 4, 2014

(65) Prior Publication Data

US 2014/0353988 A1 Dec. 4, 2014

Related U.S. Application Data

(60) Provisional application No. 61/956,144, filed on Jun. 3, 2013.

(51) Int. Cl.
*E05C 17/54* (2006.01)
*E05C 19/00* (2006.01)

(52) U.S. Cl.
CPC ..... *E05C 19/004* (2013.01); *Y10T 292/67* (2015.04)

(58) Field of Classification Search
USPC ..... 292/339, DIG. 15
See application file for complete search history.

(56) References Cited

U.S. PATENT DOCUMENTS 4,507,253 A * 3/1985 Wiesmann ..... B01F 3/0451 210/221.2
4,607,870 A * 8/1986 Crisp, Jr. ..... E05C 19/004 292/338
5,131,701 A 7/1992 Stepniewski
5,340,175 A 8/1994 Wood
5,383,254 A * 1/1995 Wigley, Sr. ..... E05B 65/0894 16/82
5,772,266 A 6/1998 Skiba
5,951,071 A 9/1999 Elliott

* cited by examiner

*Primary Examiner* — Mark Williams
(74) *Attorney, Agent, or Firm* — Renner, Kenner, Greive, Bobak, Taylor & Weber Co. LPA

(57) ABSTRACT

A door brace to prevent the opening of a door into a room or other area by an intruder includes an elongated tube that is terminated at each end by a door mounting flange and a floor mounting flange. The door mounting flange is configured to be slideably received within a bracket that is mounted to the door. The floor mounting flange includes an aperture for receiving a pin therethrough that is also received within an aperture that has been bored into the surface of the floor. Thus, when the door brace is mounted between the door and floor, the strength of the door is increased, thus preventing the door from being opened by the use of a large entry force applied to the door by an intruder seeking entry into the room or area.

20 Claims, 11 Drawing Sheets

DOOR BRACE

CROSS-REFERENCE TO RELATED APPLICATION

This application claims the benefit of U.S. Provisional Application No. 61/956,144 filed on Jun. 3, 2013, the content of which is incorporated herein by reference.

TECHNICAL FIELD

Generally, the present invention relates to door security devices to secure a door in a closed position. In particular, the present invention relates to a door brace for a door that is easily attached to and removed from a door. More particularly, the present invention relates to a door brace that is removably attached to a door at one end and removably attached to a floor surface at another end, so as to prevent the opening of a door.

BACKGROUND ART

Typically, to secure a door in a closed position to prevent unauthorized entry by an intruder, various locking devices have been developed. For example, deadbolt locking devices have been used to secure an edge of the door to a door frame. However, such deadbolt locking mechanisms provide minimal support for the door itself. That is, because the central portion of the door is left unsupported by the deadbolt locking mechanism, the door is susceptible to being breached by an intruder if the door is subjected to a large entry force.

While other types of door bracing devices have been developed to secure a door, such as door chains and door stops, such devices generally provide a limited amount of protection. For example, door chains, which attach between the door and the door frame, are generally not strong enough to withstand significant entry forces applied to the door. In addition, such door chains do not provide any support to the door itself, thus making the door susceptible to being breached or opened by an intruder if the door is subjected to a large entry force. Moreover, once the door is partially opened, the door chain can be easily severed or cut. In addition, door stops, which prevent a door from moving, do not provide any support to the central portion of the door, again making the door vulnerable to being breached or opened by an intruder if subjected to a substantial entry force.

Therefore, there is a need for a door brace that prevents a door from being breached or opened by an intruder. Furthermore, there is a need for a door brace that increases the support of a door, thereby enhancing the ability of the door to withstand large entry forces that are applied thereto by an intruder. In addition, there is a need for a door brace that prevents the door from being breached or opened, which is removably attached to the door and a floor surface in a quick and user-friendly manner.

SUMMARY OF THE INVENTION

In light of the foregoing, it is a first aspect of the present invention to provide a door brace for a door pivotably carried by one or more hinges, the door brace comprising a bracket adapted to be mounted to a surface of the door; an elongated tube terminated at a first end and a second end; a door flange attached at the first end of said tube, wherein the door flange is configured to be slideably received and retained within the bracket; and a floor flange attached at the second end of the tube, the floor flange having a flange aperture disposed therethrough, the floor flange configured to be positioned adjacent to a floor surface having a floor aperture disposed therein, whereupon a retention pin is disposed through the flange aperture and the floor aperture, wherein when the door brace is mounted between the door and the floor, the door is prevented from being opened into an area secured by the door.

It is a further aspect of the present invention to provide a method of bracing a door comprising providing an elongated tube terminated at each end by a door flange and a floor flange; mounting a bracket on a surface of a door; sliding said door flange into said bracket, such that said bracket is removably retained therein; and placing a pin through an aperture disposed in said floor flange and an aperture disposed in a floor surface.

BRIEF DESCRIPTION OF THE DRAWINGS

These and other features and advantages of the present invention will become better understood with regard to the following description, appended claims, and accompanying drawings wherein:

DETAILED DESCRIPTION OF THE INVENTION

Figure 1:
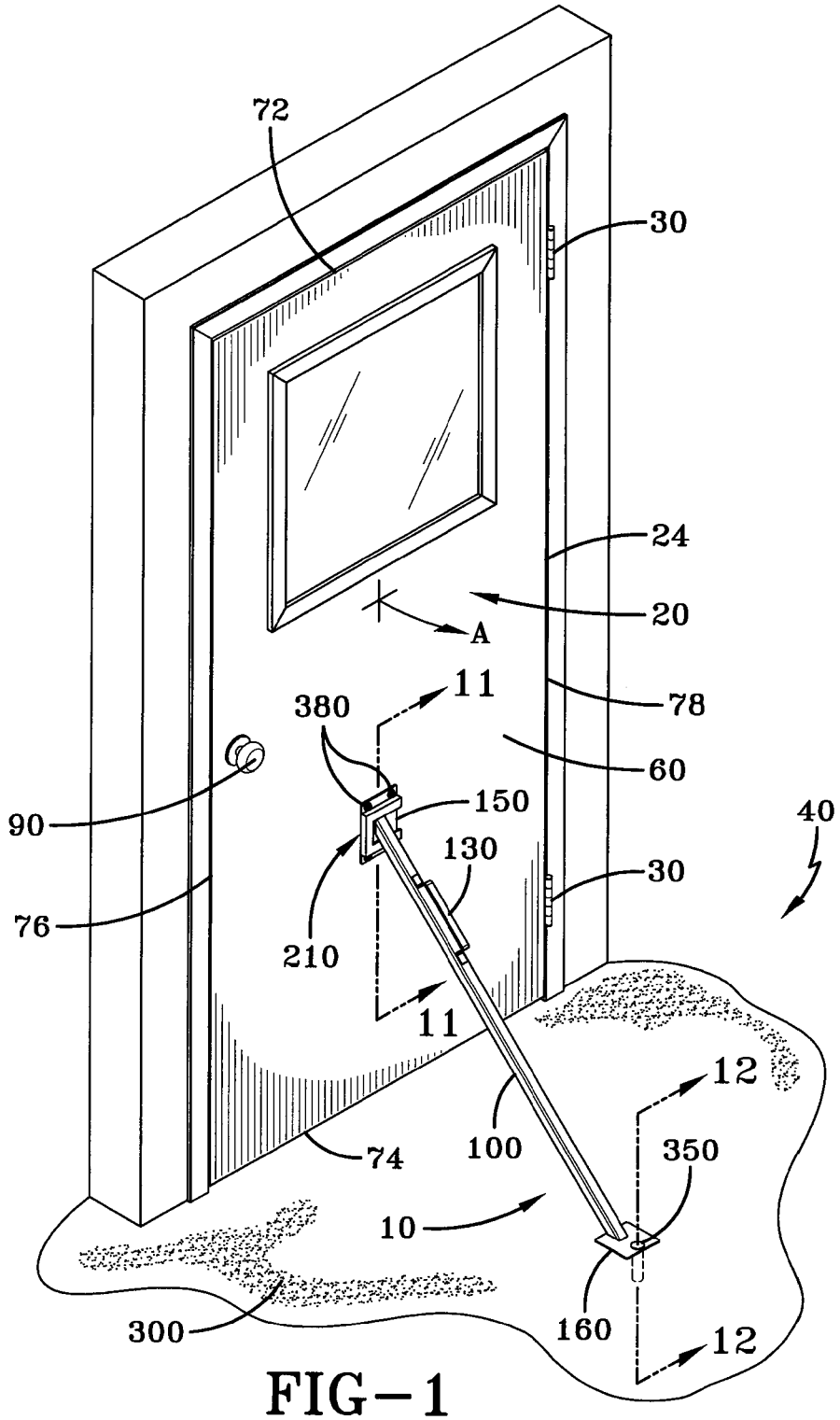
FIG. 1 is a perspective view showing a door brace removably attached to a door and a floor surface in accordance with the concepts of the present invention.

A door brace in accordance with the concepts of the present invention is generally referred to by the numeral 10, as shown in FIG. 1 of the drawings. Generally, the door brace 10 is configured for use with a door 20, which is pivotably attached within a door frame 24 by one or more hinges 30, so as to provide selective access to an enclosed area 40, such as a room. That is, the door 20 is pivotably attached to the door fame 24 via the hinges 30 or any other pivoting device, which allows the door 20 to be opened and closed. Due to the position of the hinges 30, as shown in FIG. 1, the door 30 may be opened into the area 40, as designated by arrow 'A' in the Figs., but cannot be opened in the opposite direction. The door 20 includes an inner surface 60 and opposed outer surface 70 that is bounded by upper and lower edges 72,74 and lateral edges 76,78. As such, the inner surface 60 of the door 20 is positioned within the door frame 24 so that it is proximate to the area 40 into which the door 20 opens, while the hinges 30 are attached to the lateral edge 78 of the door 20. Disposed through the inner and outer surfaces 60,70 of the door 20 is a knob 90, which allows the selective latching and unlatching of the door 20 within the door frame 24. It should be appreciated that the latching mechanism (not shown) serves to selectively secure and retain the door 20 within the door frame 24.

Figure 2:
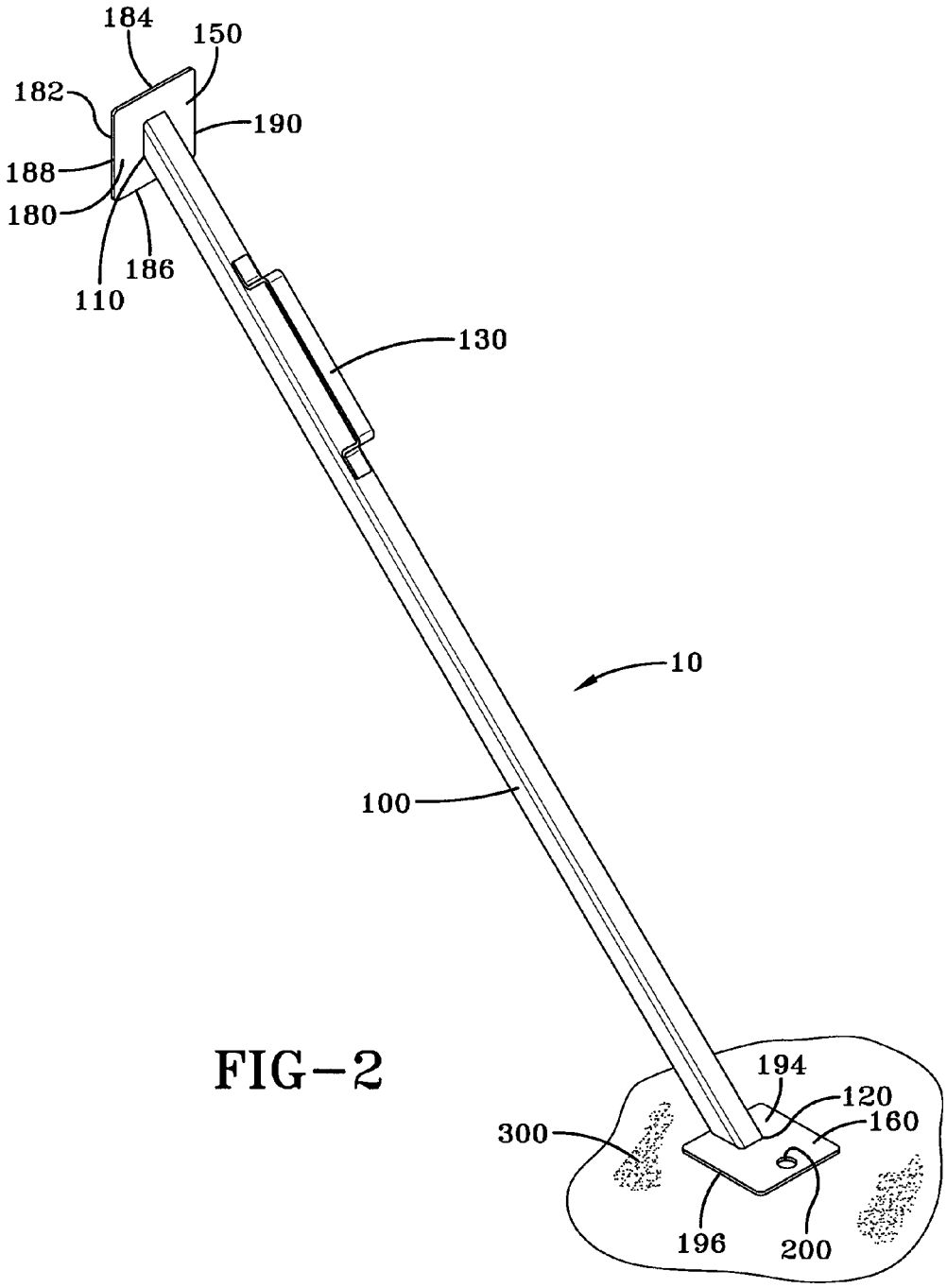
FIG. 2 is a perspective view of the door brace in accordance with the concepts of the present invention.
Figure 3:
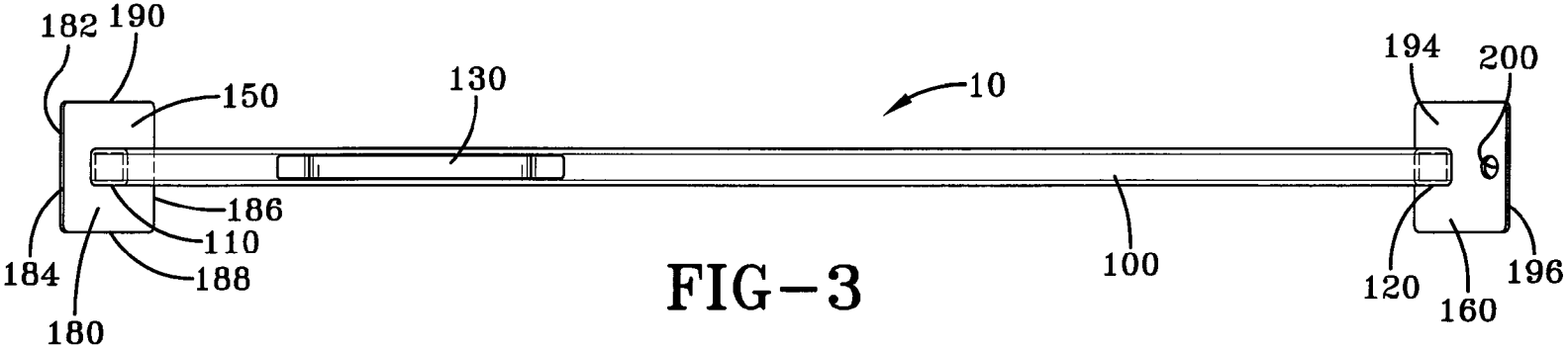
FIG. 3 is a top plan view of the door brace in accordance with the concepts of the present invention.
Figure 4:
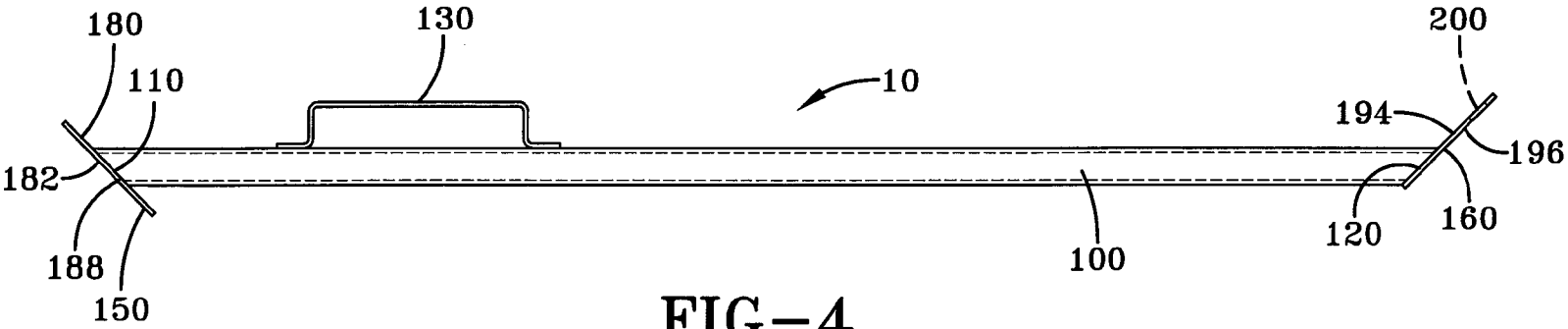
FIG. 4 is a side elevational view of the door brace in accordance with the concepts of the present invention.

Continuing to FIGS. 2-4, the door brace 10 includes an elongated tube 100, which may be formed of any suitable material, including metals such as steel, aluminum, or magnesium for example. In addition, while the tube 100 is shown as having a substantially square cross-sectional shape, the tube 100 may take one any other cross-sectional shape, such as a curvilinear or rectilinear shape or any combination thereof for example. It should also be appreciated that the tube 100 may comprise a hollow or solid cross-section. The elongated tube 100 is terminated at a door end 110 and at a floor end 120, with ends 110,120 being tapered or beveled at any suitable angle, such as an angle of about 45 degrees for example. To facilitate the transport of the door brace 10, a handle 130 is attached to the tube 100 using any suitable means of fixation, such as welding, bolts, or adhesive for example.

Attached to the door end 110 of the tube 100 is a door mounting flange 150, while a floor mounting flange 160 is attached to the floor end 120 of the tube 100. It should be appreciated that the flanges 150 and 160 may be formed of any suitable material, including metals such as steel, aluminum, or magnesium for example. Furthermore, the flanges 150 and 160 may be attached to the tube 100 using any suitable means of fixation, such as welding or rivets for example. Specifically, the door flange 150 comprises a substantially planar section having an inner surface 180 and an opposed outer surface 182 that is bounded by opposed upper and lower edges 184 and 186 and opposed lateral edges 188 and 190. The floor flange 160 also comprises a substantially planar section having an inner surface 194 and an opposed outer surface 196. A flange aperture 200, as shown clearly in FIG. 2, is disposed through the floor flange 160 at a point that is distal to the door flange 150. In one aspect, the flange aperture 200 is located so that it is in the same plane as the tube 100. It should also be appreciated that the end 110 of the tube 100 is centrally attached to the inner surface 180 of the door flange 150 at an approximately 45 degree angle. In addition, the floor end 120 of the tube 100 is attached to the inner surface 194 of the floor flange 160 at an approximately 45 degree angle.

Figure 5A:
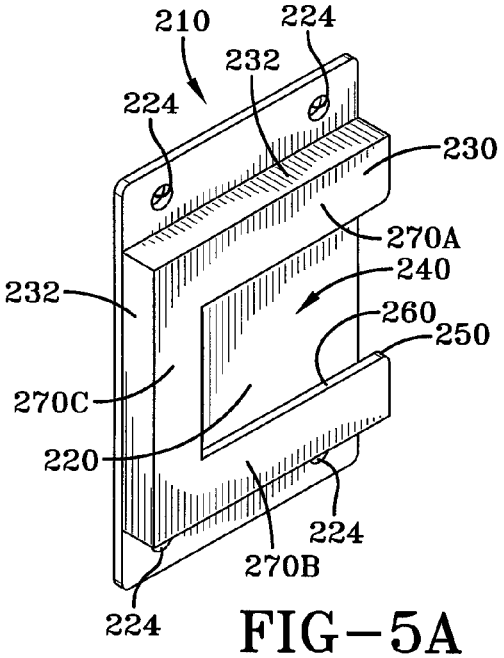
FIG. 5A is a perspective view of a bracket used to removably attach the door brace to the door in accordance with the concepts of the present invention.
Figure 5B:
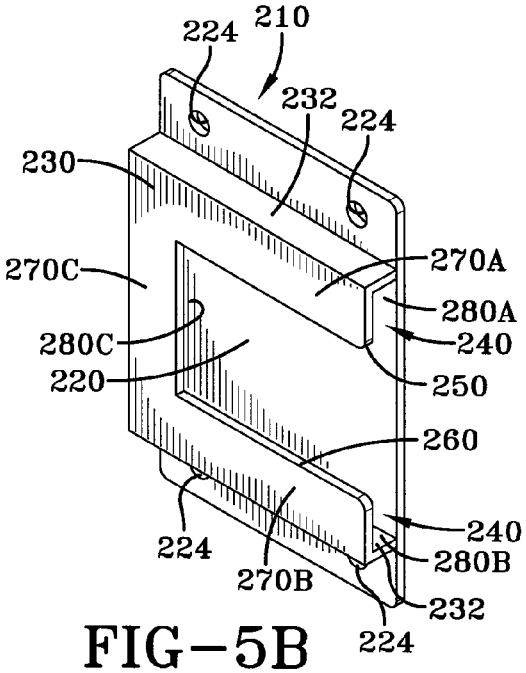
FIG. 5B is another perspective view of the bracket in accordance with the concepts of the present invention.

In order to removably retain the door brace 10 to the door 20, a retention bracket 210 is provided to slideably receive the door flange 150 therein, as shown in FIGS. 5A-B. Specifically, the bracket 210 comprises a planar base section 220 having a plurality of mounting holes 224 disposed therethrough. The base section 220 is attached to a spaced retention section 230 by a wall 232, thereby forming a gap 240 therebetween. The retention section 230 defines a receiving aperture 250 that opens into a receiving slot 260, whereby the receiving slot 260 is bounded by spaced, substantially parallel upper and lower retention sections 270A and 270B. In addition, the retention section 230 also includes a lateral retention section 270C that extends between the upper and lower retention sections 270A-B at a substantially right angle and is positioned substantially opposite to the receiving aperture 250. As such, the receiving slot 260 is defined to have a substantially rectangular shape; however, the receiving slot 260 may be configured to have any other suitable shape. Moreover, the retention sections 270A and 270B that overlap the spaced base section 220 form upper and lower retention channels 280A and 280B, while the lateral retention section 270C overlapping the base section 220 forms a lateral retention channel 280C that is disposed opposite to the receiving aperture 250. Thus, the gap 240 is dimensioned to allow the thickness of the door flange 150 to be slideably received therein, while the receiving aperture 250 and receiving slot 260 are dimensioned to slideably receive the dimension of the tube 100 therein. As such, once the tube 100 is received within the receiving slot 260, the retention sections 270A-C serve to retain the door flange 150 within the retention channels 180A-C of the bracket 210, thereby preventing the door flange 150 from being pulled out of the bracket 210. As such, the door brace 10 can be detached or released from the bracket 210 only by laterally sliding the door flange 150 back out of the receiving slot 260 and receiving aperture 250. Furthermore, while the door and floor flanges 150,160 are shown in the Figs. as substantially square sections, any other suitable shape, such as a rectilinear shape, curvilinear shape, or a combination of both may be used as long as the door flange 150 is capable of being slideably received and retained within the bracket 210.

Figure 6:
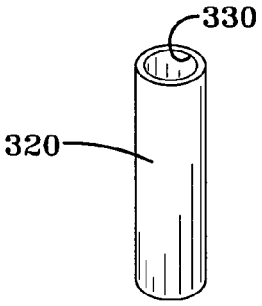
FIG. 6 is a perspective view of a sleeve configured to be mounted in the floor surface and configured to receive a pin therein in accordance with the concepts of the present invention.
Figure 7:
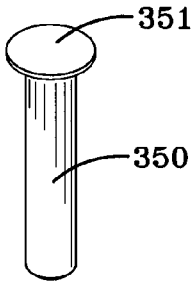
FIG. 7 is a perspective view of the pin used to secure the door brace to the floor surface in accordance with the concepts of the present invention.
Figure 8:
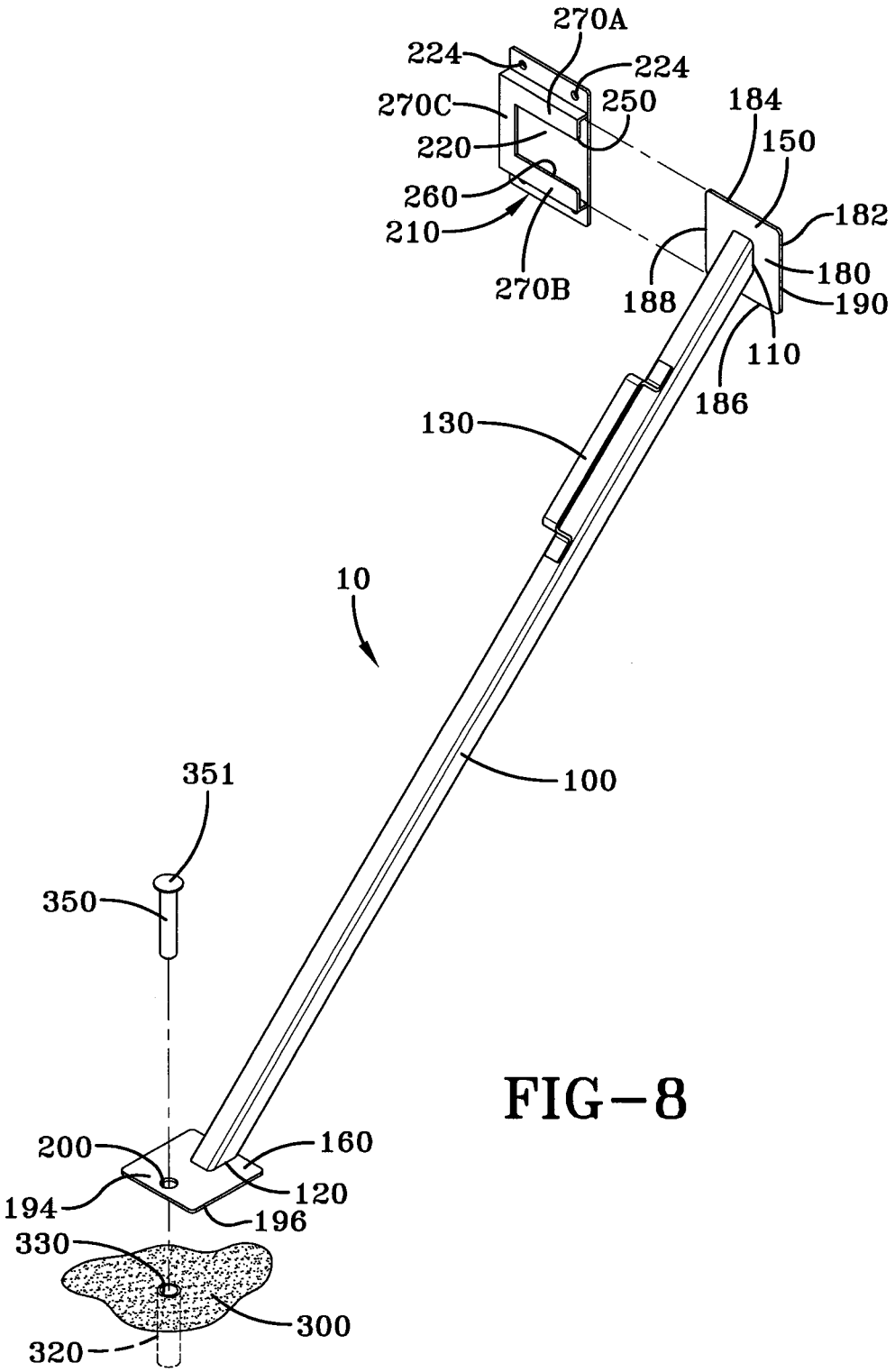
FIG. 8 is a perspective view showing the door brace slid out of the bracket and the pin removed from the door brace in accordance with the concepts of the present invention.
Figure 12:
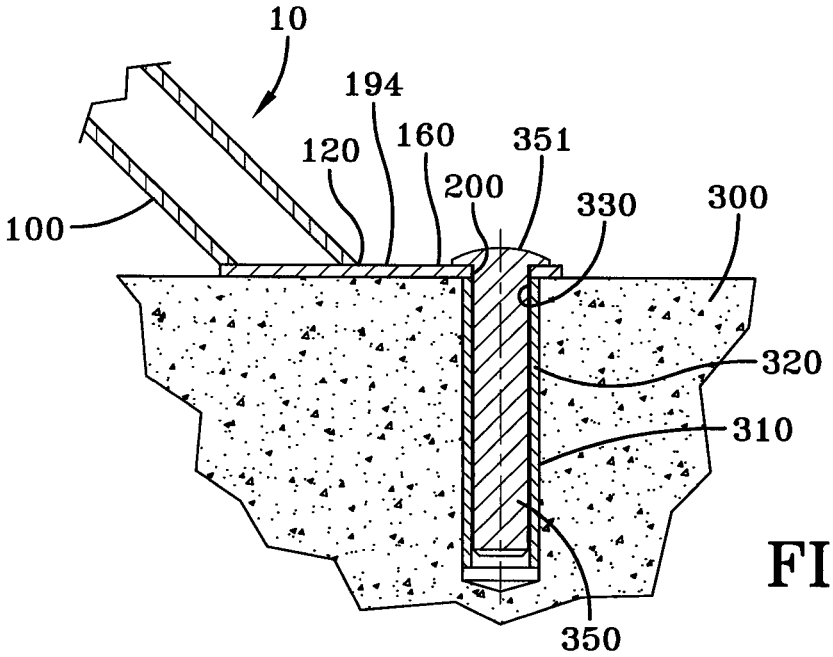
FIG. 12 is a cross-sectional view showing the floor flange attached to the floor surface via the pin and sleeve in accordance with the concepts of the present invention.

In order to secure the floor flange 160 of the door brace 10 to a floor surface 300, as shown clearly in FIG. 12, a mounting aperture 310 is disposed in the floor surface 300. Lining the mounting aperture 310 is a cylindrical sleeve 320 having a sleeve aperture 330 disposed therethrough, as shown in FIGS. 6, 8, and 12. The sleeve 320 may be formed from any suitable material, such as steel, aluminum, or magnesium for example. The sleeve aperture 330 is dimensioned to removably receive a pin 350, as shown in FIGS. 7, 8, and 12, or any other elongated member capable of being removably carried within the sleeve aperture 330. The pin 350 is formed of any suitable material, such as metal including steel, aluminum, or magnesium for example. It should also be appreciated that the pin 350 may include a raised or elevated head 351 to facilitate the insertion and removal of the pin 350. In addition, the head 351 may include a grasping loop or other device that is attached to the head or top of the pin to facilitate the removal of the pin 350 out of the sleeve aperture 330.

Figure 11:
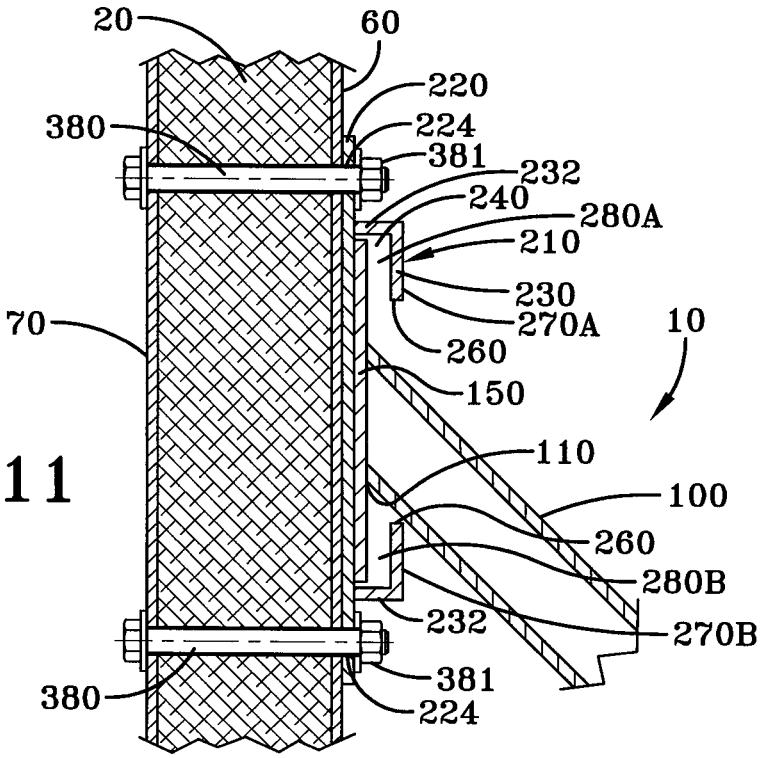
FIG. 11 is a cross-sectional view showing the bracket with the door flange received therein in accordance with the concepts of the prevent invention.

To place the door brace 10 into use, the bracket 210 is initially attached to the inner surface 60 of the door 20 using fasteners 380, such as bolts, that are threadably retained by a nut 381 or other fastening device that is disposed proximate to the inner surface 60 of the door 20, as shown in FIG. 11. In one aspect, the fasteners 380 may be positioned so that the nut is disposed proximate to the inner surface 60 of the door 20. This prevents an intruder from attempting to enter the door 20 by easily releasing the fasteners 380. Moreover, the head of the fastener 380 may be formed to have a proprietary shape or configuration that requires specialized tooling to hold and unfasten the fastener 380, thus preventing the intruder from easily removing the fastener 380. However, it should be appreciated that the bracket 210 may be attached to the door 20 using any suitable means of fixation, such as adhesive, screws, rivets or the like, that are received through the bracket apertures 224. The bracket 210 is positioned on the door 20 so that the lateral receiving aperture 250 is proximate to and substantially parallel to the lateral edge 78 of the door 20 or, alternatively, such that the receiving aperture 250 is proximate to and substantially parallel to the lateral edge 76 of the door 20. Furthermore, the bracket 210 may be mounted so that it is substantially centered between the lateral edges 76 and 78 of the door 20 and below the knob 90. In another aspect, the bracket 210 may be mounted so that it is substantially centered between the lateral edges 76,78 and the upper and lower edges 72,74 of the door 20. However, in alternative embodiments, the bracket 210 may be attached to the door 20 in other orientations, whereby the receiving aperture 250 is positioned relative to other portions of the door 20. For example, the bracket 210 may be attached to the door 20 so that the receiving aperture 250 is proximate to either of the upper and lower edges 72,74 or the lateral edges 76,78. In one aspect, it should be appreciated that the bracket 210 may be made integral with the door 20.

Figure 9:
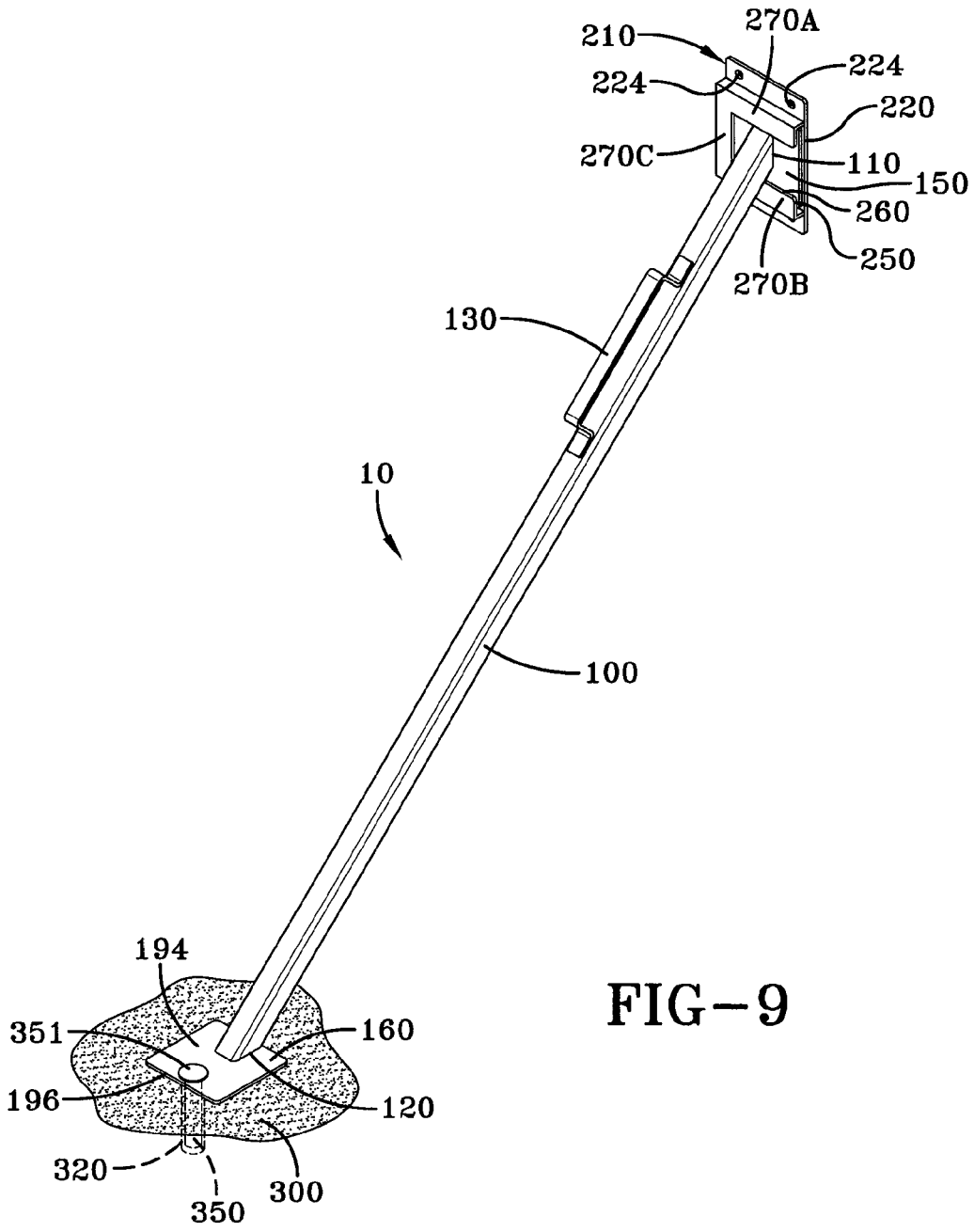
FIG. 9 is a perspective view showing the door brace slid into the bracket and the pin attached to the door brace in accordance with the concepts of the present invention.
Figure 10:
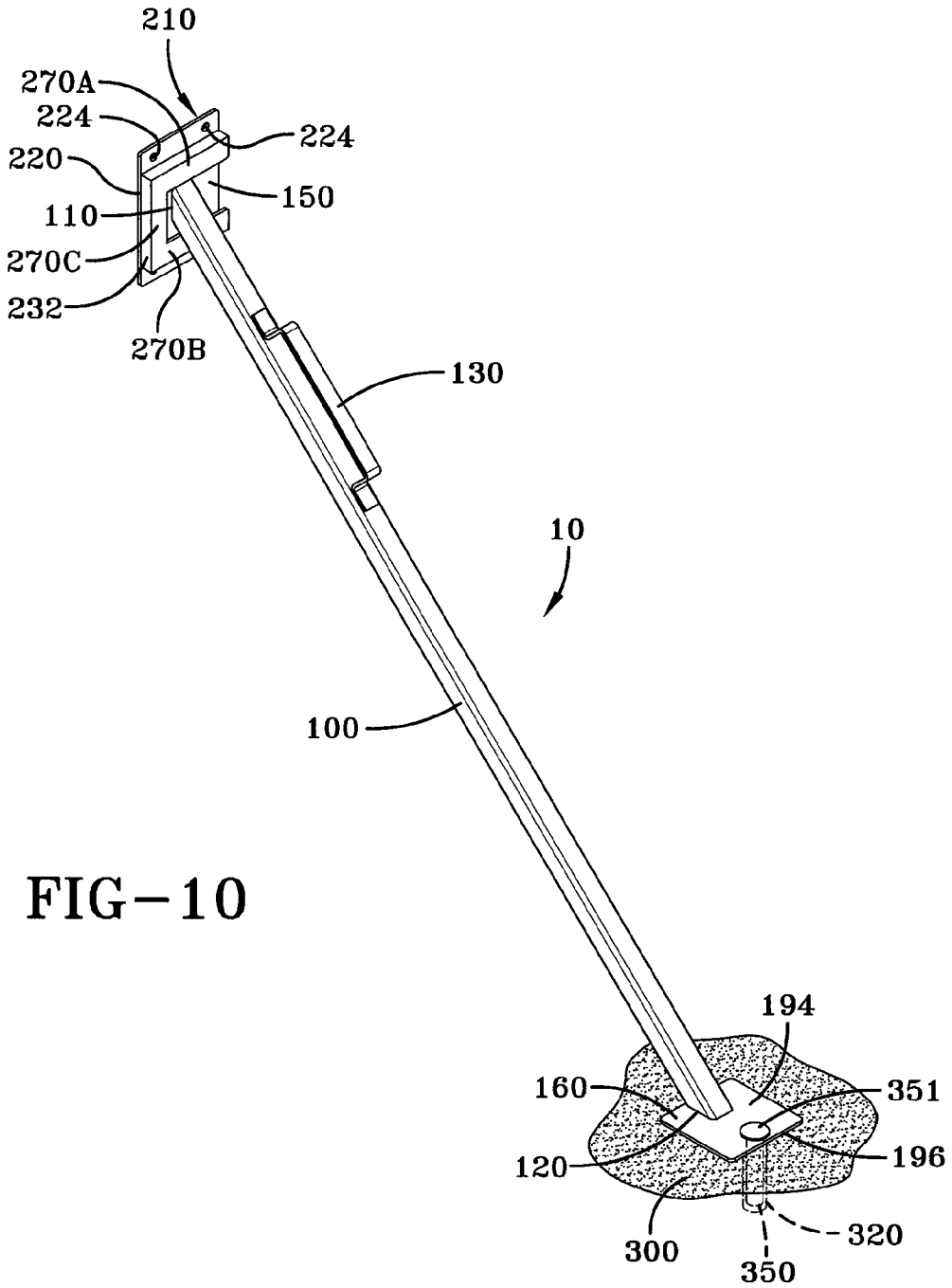
FIG. 10 is another perspective view showing the door brace slid into the bracket and the pin attached to the door brace in accordance with the concepts of the present invention.

Next, the door flange 150 of the door brace 10 is attached to the retention bracket 210. Specifically, the door flange 150 is slid laterally into the gap 240, such that the tube 100 is received through the receiving aperture 250 and brought to rest within the receiving slot 260, as shown in FIGS. 8-10. As such, the door flange 150 is received within each of the retention channels 280A-C of the bracket 210, such that the upper and lower ends 184,186 of the flange 150 are received within respective retention channels 280A-B, and the lateral edge 188 of the flange 150 is received within the retention channel 280C. Once the door brace 10 is attached to the bracket 210, the floor flange 160 is positioned adjacent to the floor surface 300, such that the flange aperture 200 is aligned with the sleeve aperture 330 of the sleeve 320 mounted in the floor surface 300. Once the flange aperture 200 and the sleeve aperture 330 are aligned, the pin 350 is slideably received through the flange aperture 200 and the sleeve aperture 330, thereby securing the floor flange 160 to the floor surface 300. Thus, with the door flange 150 secured to the door 20, as shown in FIG. 11, and the floor flange 160 secured to the floor surface 300, as shown in FIG. 12, the door brace 10 provides increased support to the door 20, thereby preventing the door 20 from being opened into the area or room 40.

Figure 13:
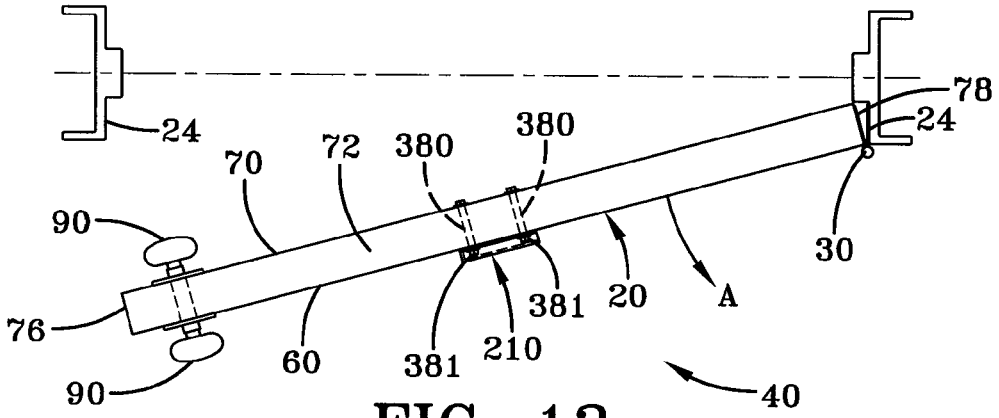
FIG. 13 is a top plan view of the door in the process of being closed without the door brace attached thereto in accordance with the concepts of the present invention.
Figure 14:
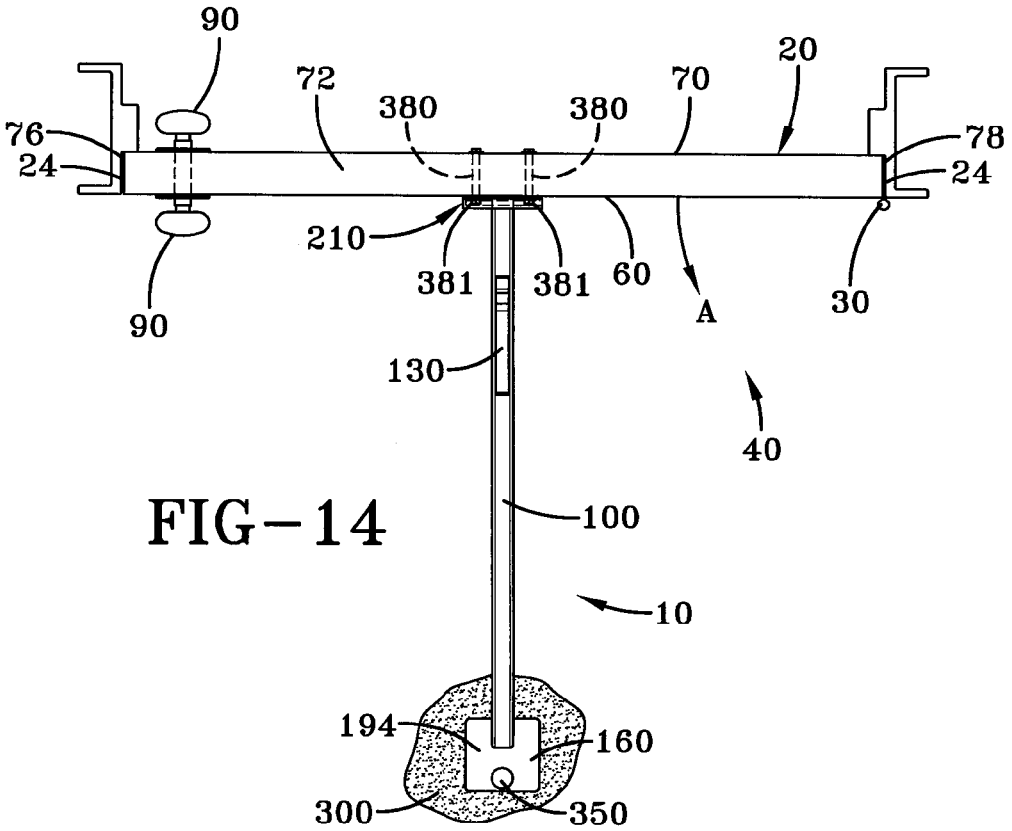
FIG. 14 is a top plan view of the door retained in a closed position by the door brace in accordance with the concepts of the present invention.

Thus, in summary, to prevent the door 20 from being pushed open, the door 20 is shut, as shown in FIG. 13, and the door brace 10 is slideably attached to the retention bracket 210 that has been previously attached to the door 20, and the floor flange 160 is attached to the floor 300 by the pin 350, as shown in FIG. 14. As such, when pushing forces are applied to the outer surface 70 of the door 20 by an intruder, the retention bracket 210 mounted to the door 20 retains the door flange 150 therein, and the pin 350 retains the floor flange 160 to the floor 300, and as a result the applied force is transferred from the door 20, through the door brace 10, and to the floor 300. As such, the strength of the door 20 is increased, enabling it to withstand large entry forces without being breached or opened, thereby providing increased security and protection to the people and contents within the area 40 into which the door 20 opens.

Figure 15:
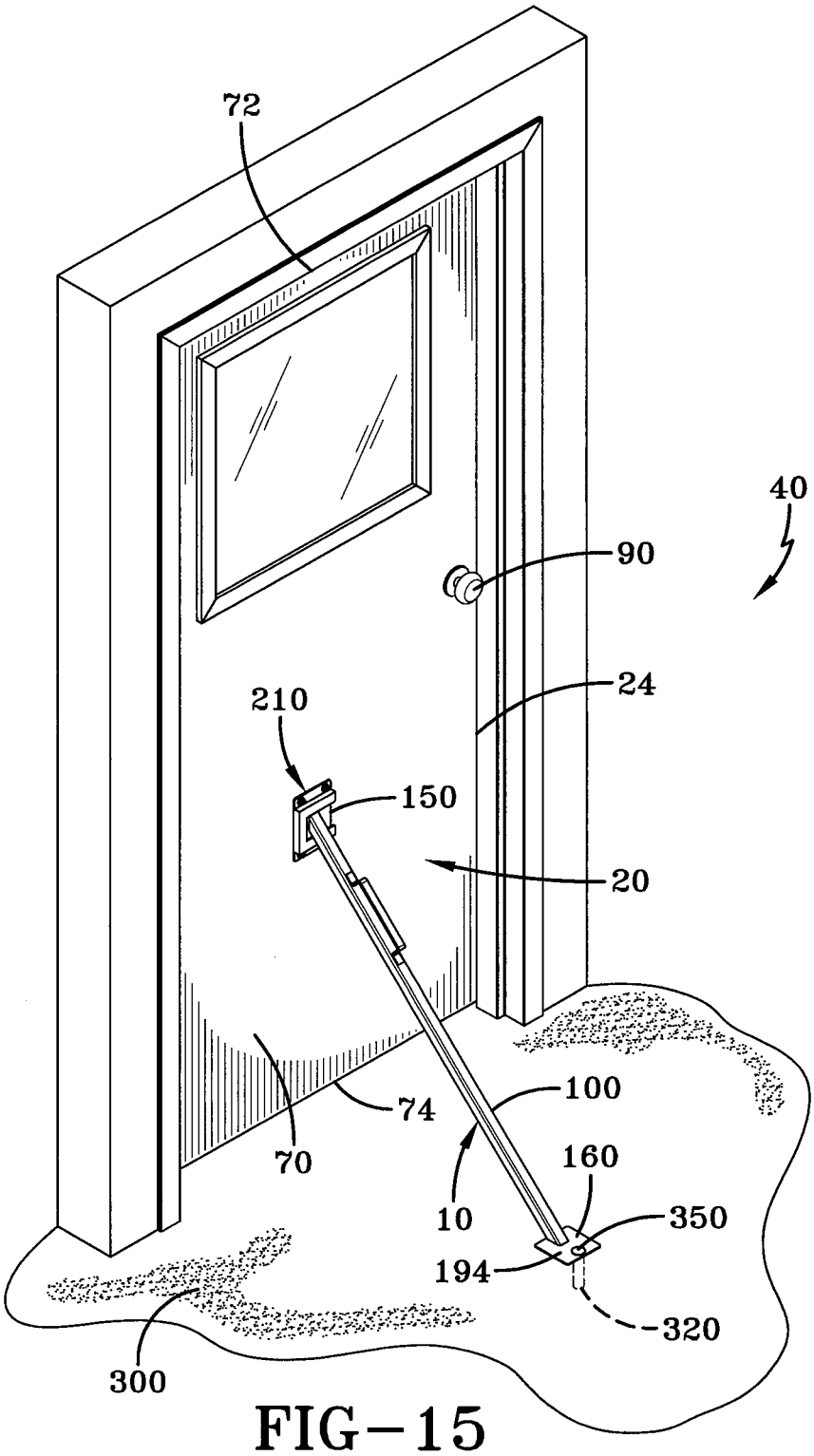
FIG. 15 is a perspective view of the door brace attached to an outer surface of the door and attached to the floor in accordance with the concepts of the present invention.
Figure 16:
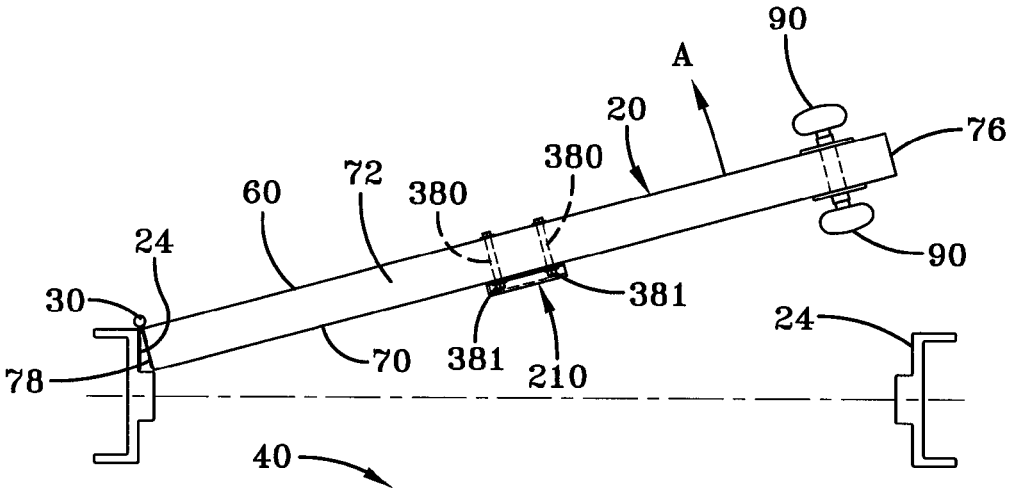
FIG. 16 is a top plan view of the door in the process of being closed without the door brace attached thereto in accordance with the concepts of the present invention.
Figure 17:
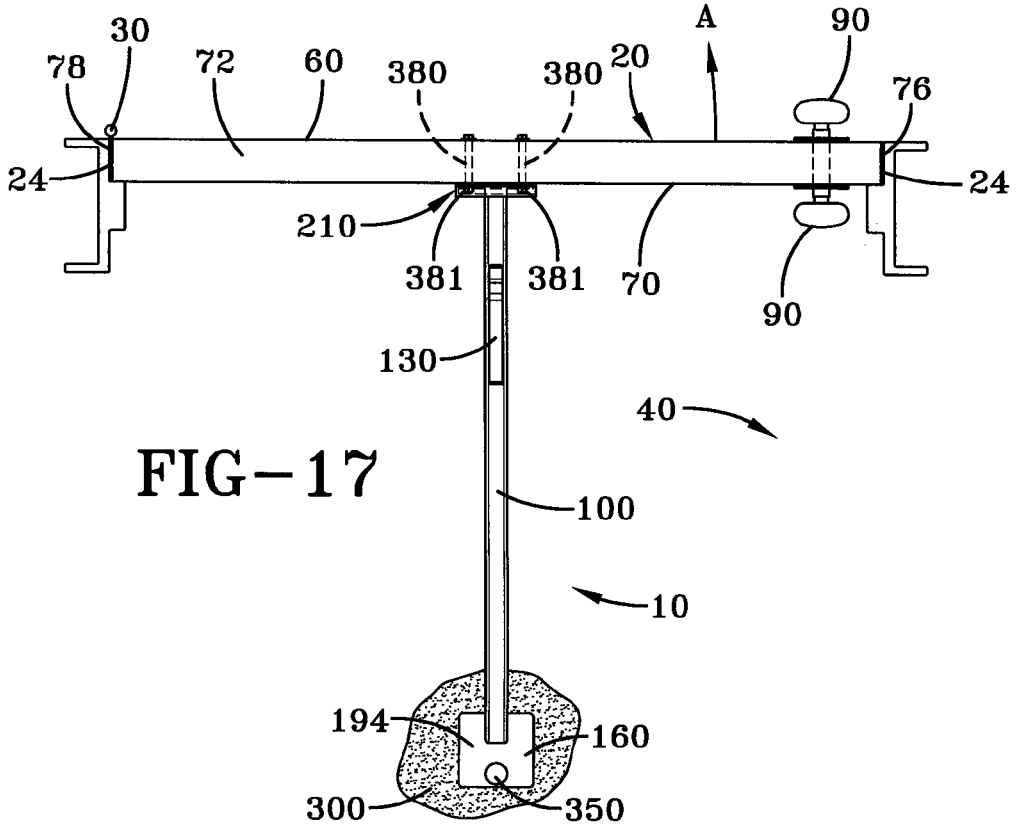
FIG. 17 is a top plan view of the door retained in a closed position by the door brace in accordance with the concepts of the present invention.

In an alternative embodiment, the door brace 10 may be mounted to the outer surface 70 of the door 20, as shown in FIG. 15, to prevent an intruder from pulling the door 20 open by applying pulling forces to the inner surface 60 of the door 20 to gain entry into the area 40. As such, the retention bracket 210 is mounted to the outer surface 70 of the door 20, and the door brace is 10 is attached to the retention bracket 210 and to the floor surface 300 in the manner previously discussed. Thus, once the door 20 is shut, as shown in FIG. 16, the door brace 10 is attached to the retention bracket 210 and to the sleeve aperture 330 disposed in the floor surface 300, as shown in FIG. 17, as previously discussed. As such, any pulling forces applied to the inner surface 60 of the door 20 by an intruder are effectively transferred from the door 20, through the door brace 10, and to the floor 300, as previously discussed above. As such, the door 20 is able to withstand large entry forces without being breached or opened, thereby providing increased security and protection to the people and contents within the area 40 into which the door 20 opens.

Furthermore, while the components of the door brace 10 have been discussed as being formed from metal, it should be appreciated that one or more of the components of the door brace 10 may be formed from high-strength plastic.

Based on the foregoing, one advantage of the present invention is that a door brace provides a user-friendly device for securing a door. Another advantage of the present invention is that the door brace is easily and quickly mounted between a door and a floor surface. Still another advantage of the present invention is that the door brace substantially enhances the strength of the door, increasing the ability of the door to secure an area. Yet another advantage of the present invention is that the door brace prevents a door from being breached or opened by large entry forces applied to the door by an intruder.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A door brace for a door positioned relative to a floor surface having a floor aperture disposed therein, the door brace comprising:

a bracket having a base section that is spaced away from a retention section to form a gap therebetween, wherein said base section is adapted to be mounted proximate to a surface of the door, and said retention section has a receiving slot that includes an open end positioned at an edge of said retention section;

an elongated tube terminated at a first end and a second end;

a door flange attached at said first end of said tube, wherein said door flange is configured to be received into said gap so that said tube extends through said receiving slot, with said retention section retaining said door flange in said gap; and a floor flange attached at said second end of said tube, said floor flange having a flange aperture disposed therethrough, said floor flange configured to be positioned adjacent to the floor surface to allow a retention pin to be disposed through said flange aperture and the floor aperture.

2. The door brace of claim 1, wherein said tube extends from said door flange at about a 45 degree angle thereto.

3. The door brace of claim 2, wherein said tube extends from said floor flange at about a 45 degree angle thereto.

4. The door brace of claim 1, further comprising a metal sleeve adapted to be disposed within the floor aperture, the pin being configured to be received within a sleeve aperture disposed in said metal sleeve.

5. The door brace of claim 1, further comprising a handle attached to said tube.

6. A method of bracing a door comprising:

providing an elongated tube terminated at each end by a door flange and a floor flange, respectively;

mounting a bracket to the door, wherein said bracket includes a base section that is positioned proximate to a surface of the door, said base section being spaced away from a retention section to form a gap therebetween, and said retention section having a receiving slot with an open end positioned at an edge of said retention section;

moving said door flange into said gap so that said elongated tube extends through said receiving slot so that said door flange is retained in said gap by said retention section; and placing a pin through an aperture disposed in said floor flange and an aperture disposed in a floor surface.

7. The method of claim 5, wherein said open end of said slot is positioned proximate to a lateral edge of the door.

8. The door brace of claim 1, wherein said base section and said retention section are parallel to each other.

9. The door brace of claim 8, wherein said base section and said retention section are joined together by at least one wall extending through said gap.

10. The door brace of claim 1, wherein a longitudinal axis of said receiving slot is parallel with said base section.

11. The door brace of claim 1, wherein said retention section includes a first section and a second section that are parallel to each other and spaced apart by said slot, said first section and said second section extending parallel to said base section.

12. The door brace of claim 11, wherein said retention section further includes a third section that is perpendicular to said first section and said second section.

13. The door brace of claim 12, wherein said first section, said second section, and said third section are joined to said base section by at least one wall extending through said gap.

14. The method of claim 7, wherein said open end of said slot is positioned proximate to a lateral edge of the door.

15. The method of claim 7, wherein said base section and said retention section are parallel to each other.

16. The method of claim 15, wherein said base section and said retention section are joined together by at least one wall extending through said gap.

17. The method of claim 7, wherein a longitudinal axis of said receiving slot is parallel with said base section.

18. The method of claim 7, wherein said retention section includes a first section and a second section that are parallel to each other and spaced apart by said slot, said first section and said second section extending parallel to said base section.

19. The method of claim 18, wherein said retention section further includes a third section that is perpendicular to said first section and said second section.

20. The method of claim 19, wherein said first section, said second section, and said third section are joined to said based section by at least one wall extending through said gap.

* * * * *